US008718315B2

(12) United States Patent
Toivola et al.

(10) Patent No.: US 8,718,315 B2
(45) Date of Patent: May 6, 2014

(54) METHOD AND APPARATUS FOR CONNECTOR PLUG CHANGEABLE PINNING ORDER

(75) Inventors: Timo Tapani Toivola, Turku (FI); Jari Kinanen, Salo (FI)

(73) Assignee: Nokia Corporation, Espoo (FI)

( * ) Notice: Subject to any disclaimer, the term of this patent is extended or adjusted under 35 U.S.C. 154(b) by 123 days.

(21) Appl. No.: 13/325,526

(22) Filed: Dec. 14, 2011

(65) Prior Publication Data

US 2013/0156249 A1 Jun. 20, 2013

(51) Int. Cl.
*H04R 25/00* (2006.01)

(52) U.S. Cl.
USPC ..... 381/384; 381/379

(58) Field of Classification Search
USPC ..... 381/384, 379; 439/668, 660, 584, 164, 439/638, 669, 170–175
See application file for complete search history.

(56) References Cited

U.S. PATENT DOCUMENTS

| | | | | |
|---|---|---|---|---|
| 6,979,231 | B2 * | 12/2005 | Shinohara | 439/669 |
| 7,553,195 | B2 * | 6/2009 | Matsumoto et al. | 439/669 |
| 7,780,478 | B2 * | 8/2010 | Tang et al. | 439/668 |
| 8,358,800 | B2 * | 1/2013 | Wu et al. | 381/384 |
| 2008/0318629 | A1 | 12/2008 | Inha et al. | 455/557 |
| 2009/0130910 | A1 | 5/2009 | Inha et al. | 439/638 |
| 2012/0178296 | A1 * | 7/2012 | Liang et al. | 439/620.01 |

* cited by examiner

*Primary Examiner* — Brian Ensey
(74) *Attorney, Agent, or Firm* — Harrington & Smith

(57) ABSTRACT

In accordance with an example embodiment of the present invention, an apparatus is disclosed. The apparatus includes a connector plug housing member and a connector plug contact member. The connector plug housing member includes a first contact pin and a second contact pin. The connector plug contact member includes a first contact section and a second contact section. The connector plug contact member is configured to be positioned in the connector plug housing member in a first position. The connector plug contact member is configured to be positioned in the connector plug housing member in a second position. The first position corresponds to a first pinning order. The second position corresponds to a second pinning order.

21 Claims, 7 Drawing Sheets

METHOD AND APPARATUS FOR CONNECTOR PLUG CHANGEABLE PINNING ORDER

TECHNICAL FIELD

The invention relates to a connector plug configured to have a changeable pinning order and, more particularly, to a headset plug suitable for different pinning orders.

BACKGROUND

Electronic devices include many different features, and as electronic devices continue to become more sophisticated, these devices provide an increasing amount of functionality. Many of these devices include connector interfaces allowing for peripheral components to be connected to the device and/or communication to other electronic devices.

As such, features for electronic devices are increasing in number. Thus, the electronic device facilitates a better user experience. Therefore versatile user interface components are needed in order to take full advantage of capabilities of mobile devices.

SUMMARY

Various aspects of examples of the invention are set out in the claims.

According to a first aspect of the present invention, an apparatus is disclosed. The apparatus includes a connector plug housing member and a connector plug contact member. The connector plug housing member includes a first contact pin and a second contact pin. The connector plug contact member includes a first contact section and a second contact section. The connector plug contact member is configured to be positioned in the connector plug housing member in a first position. The connector plug contact member is configured to be positioned in the connector plug housing member in a second position. The first position corresponds to a first pinning order. The second position corresponds to a second pinning order.

According to a second aspect of the present invention, a method is disclosed. A connector plug housing member having a first contact pin and a second contact pin is provided. A connector plug contact member having a first contact section and a second contact section is provided. The connector plug contact member is configured to be removably received in the connector plug housing member in a first position. The connector plug contact member is configured to be removably received in the connector plug housing member in a second position. The first position corresponds to a first pinning order. The second position corresponds to a second pinning order.

According to a third aspect of the present invention, an apparatus is disclosed. The apparatus includes an earpiece section, an input control section, and a connector plug section. The input control section is connected to the earpiece section. The connector plug section is connected to the input control section. The connector plug section includes a removable connector plug contact member. The removable connector plug contact member is configured to be removably received at the plug section in a first orientation and a second different orientation.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

An example embodiment of the present invention and its potential advantages are understood by referring to FIGS. 1 through 9 of the drawings.

Figure 1:
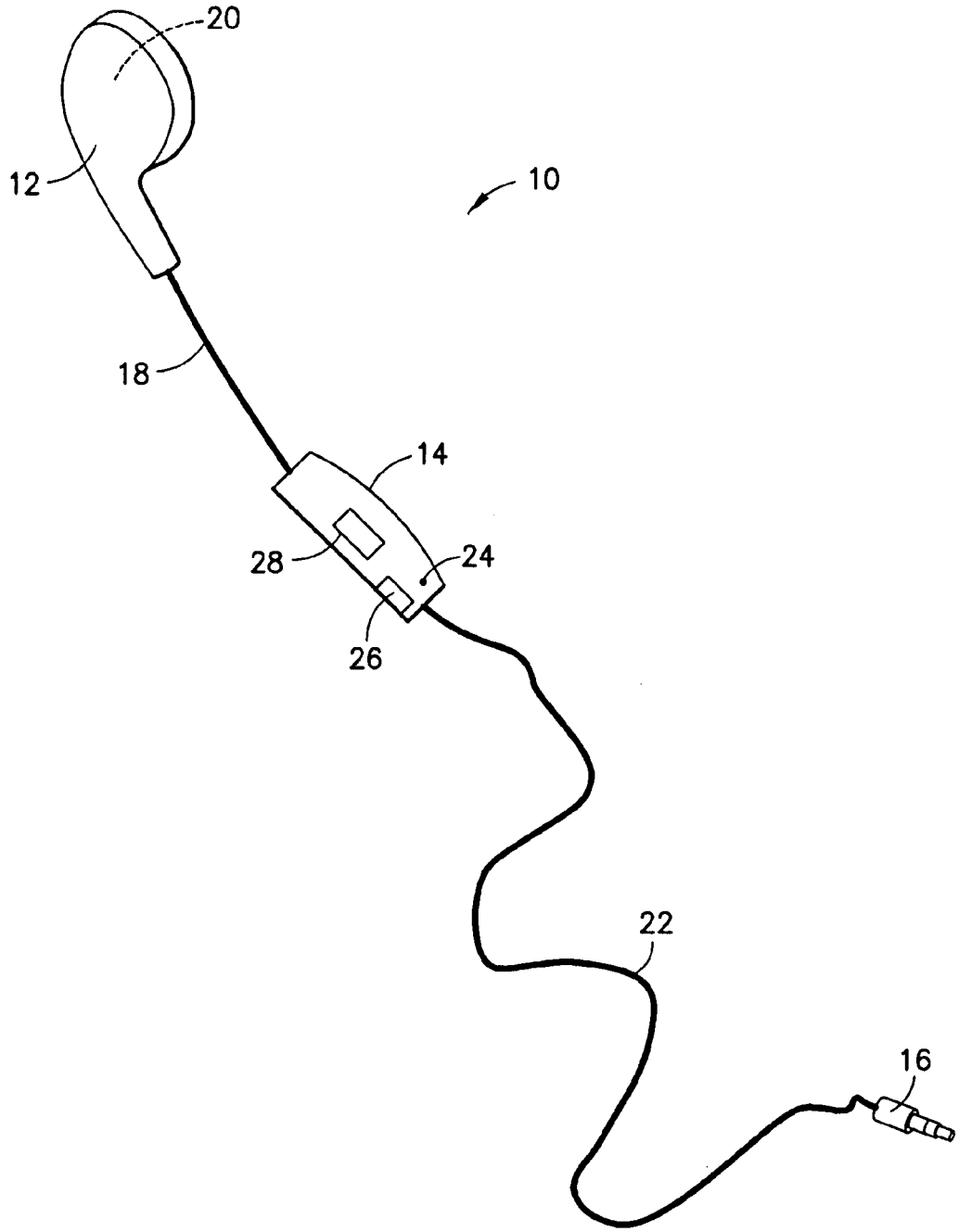
FIG. 1 is a perspective view of headset device incorporating features of the invention.

Referring to FIG. 1, there is shown a perspective view of a headset device 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

According to one example of the invention, the headset device 10 comprises a single earpiece headset. However, in alternate embodiments, features of the various embodiments of the invention could be used in any suitable type of headset device such as mobile phone hands free headset, a double ear piece headset, an "over the head" headset, an "over the ear" headset, for example. In other alternate embodiments, features of the various embodiments of the invention could be used in any suitable type of peripheral device (such as headphones or earphones for example) which utilizes a connector or plug which can provide an end-termination for cabling and can be used to connect the peripheral device to an electronic device. The connector/plug is generally configured to provide releasable connection with a jack or socket. In this way, the electronic device is able to output and receive information.

According to various exemplary embodiments of the invention, the headset device is configured to be connected to any suitable type of electronic device such as a mobile phone, a gaming device, a music player, or a PDA, for example. In addition, as is known in the art, the electronic device can include multiple features or applications such as a camera, a music player, a game player, or an Internet browser, for example. The electronic device generally comprises a housing, a transmitter, a receiver, an antenna (connected to the transmitter and the receiver), electronic circuitry, such as a controller (which could include a processor, for example) and a memory for example, within the housing, a user input region and a display. However, any suitable type of features as known in the art, can be provided.

The headset device 10 comprises an earpiece section 12, an input control section 14, and a connector plug section 16. The earpiece section 12 is connected to the input control section 16 by a cable 18. The earpiece section 12 comprises a loudspeaker element 20. The input control section 14 is connected to the connector plug section 16 by a cable 22. The input control section 14 may comprise a microphone 24 and a mute switch 26. The input control section 14 may further comprise a function switch 28, which is configured to actuate accepting or terminating a call, and/or other functions relating to the headset 10. However, in some embodiments of the invention, the switch is not present. In some embodiments, a plurality of switches and/or other input devices may be provided. However, in alternate embodiments, the input control section may comprise any suitable type of features as known in the art.

It should be understood that many variations of mechanical design are possible without departure from the spirit of the invention. For example, the headset 10 may be provided with various removable or extendable elements for improving ergonomics, such as an ear loop part for supporting the earpiece member in its use position. Additionally, while a monaural wireless headset 10 is illustrated in the drawings, a stereophonic headset may be provided without departing from the spirit of the invention.

The headset 10 is generally configured to be worn by the user in such a way that an audio signal provided by the loudspeaker element 20 is audible for the user, and the microphone 24 captures the voice of the user. In an embodiment, the earpiece section 12 is suitably sized and shaped to be received in the ear of the user with the loudspeaker element 20 disposed in the earpiece section 12 and suitably positioned with respect to the ear. The input control section 14 is suitably positioned between the earpiece section 12 and the connector plug section 16 such that the microphone 24 may be proximate to the mouth of the user when the headset 10 is being worn by the user.

Figure 2:
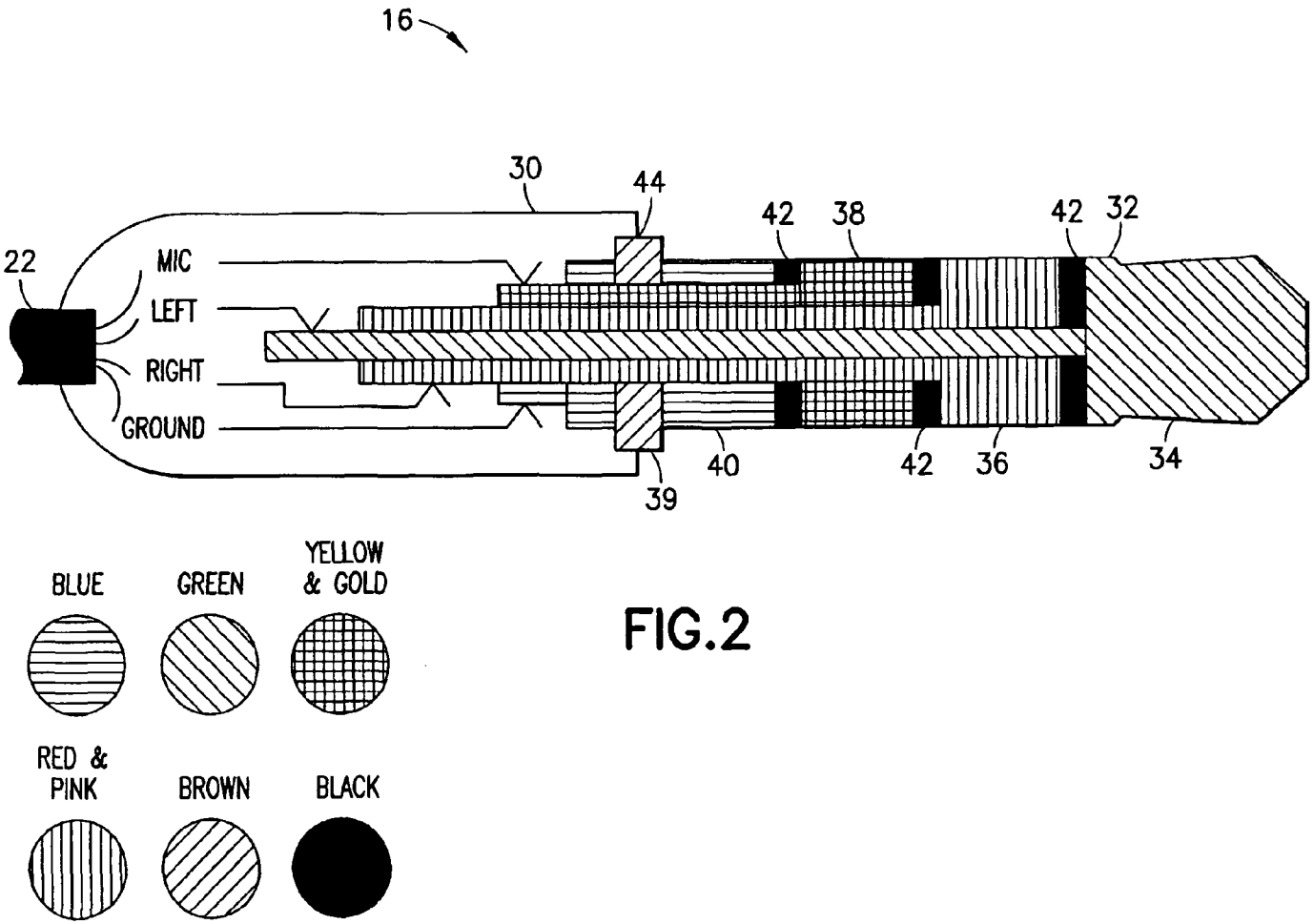
FIG. 2 is a cross section view of a connector plug section of the headset device shown in FIG. 1.

Referring now also to FIG. 2, the connector plug section 16 comprises a connector plug housing member 30 and a connector plug contact member 32. The connector plug housing member 30 and the connector plug contact member 32 are separate members which are shown in a 'mated' configuration/position in FIG. 2. The connector plug section 16 is configured to provide a changeable pinning arrangement for the headset 10.

Electronic devices, such as mobile phones for example, generally use a four (4) pin headset connector for wired headsets. The pins generally correspond to left and right speaker signal, ground, and microphone signal. However, there is more than one industry accepted pinning order for four pin headset connectors. One industry accepted pinning order is generally referred to as OMTP (Open Mobile Telephony Platform). Another industry accepted pinning order is generally referred to as AHJ (American Headset Jack). OMTP and AHJ pinning orders both correspond to the same size headset connector, however one difference is that microphone line and ground line are 'swapped' (or reversed) when comparing OMTP and AHJ. Various exemplary embodiments of the invention provide for changeable pinning order on a headset plug in order to correspond with the OMTP or the AHJ pinning order.

The connector plug contact member 32 comprises a tip section 34 (shown in 'green'), a first ring section (shown in 'red'), a second ring section 38 (shown in 'yellow'), an alignment section 39 (shown in 'brown'), and a sleeve section 40 (shown in 'blue'). The connector plug contact member 32 further comprises insulating sections 42 (shown in 'black') between the tip section 34, the first ring section 36, the second ring section 38, and the sleeve section 40. The tip section 34, the first ring section 36, the second ring section 38, and the sleeve section 40 provide electrical contact areas, spaced along a length of the connector. The contact areas are generally separated by the insulating material 42 to keep the areas separate from each other. It should be noted that, although the connector plug contact section has been described in connection with a four pin configuration having two ring sections, one skilled in the art will appreciate that embodiments of the invention are not necessarily so limited and that alternate embodiments may comprise more or less pins and ring sections.

The configuration illustrated in FIG. 2 corresponds to the OMTP standard wherein, the sleeve section 40 provides a ground signal, the second ring section 38 provides a control/microphone signal, the first ring section 36 provides a right audio channel signal, and the tip section 34 provides a left audio channel signal. The configuration of the contact areas provides an electrical configuration pattern (or circuit pattern) for the connector plug.

The connector plug contact member 32 may comprise a circular connector configuration such as a 2.5 mm or 3.5 mm connector commonly used for audio/video connections, for example. The connector plug contact member 32 is configured to be insertable into a connector socket of an electronic device. However, the connector plug contact member may be configured to be insertable into any suitable type of connector socket. When the connector plug contact member of the connector plug is inserted into a connector socket or jack, the contact areas of the connector plug contact member form an electrical connection with mating contact areas of the connector socket.

Figure 3:
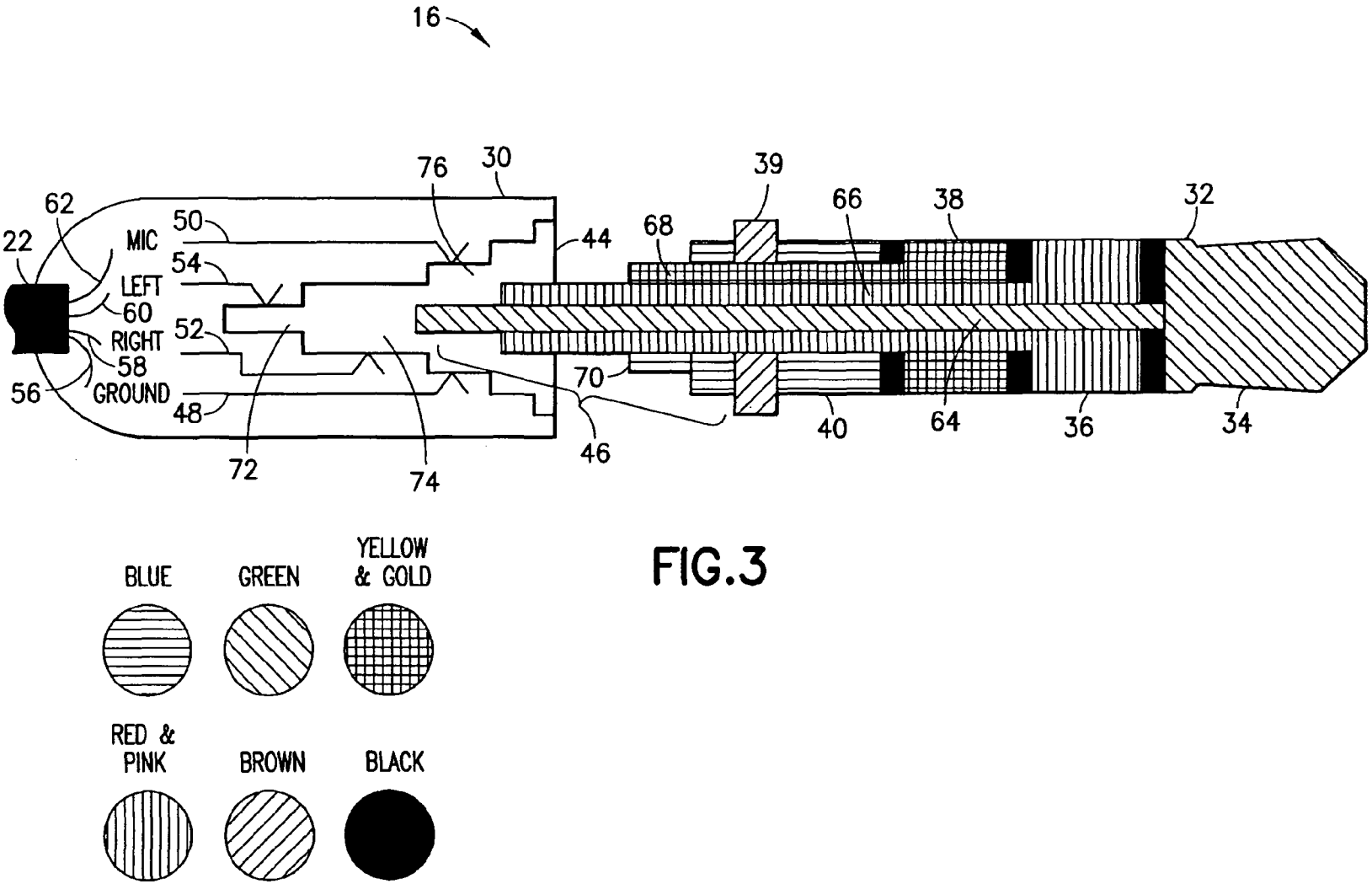
FIG. 3 is a cross section view of the connector plug section shown in FIG. 2 in a removed/separated configuration/position.

Referring now also to FIG. 3, the connector plug housing member 30 and the connector plug contact member 32 are shown in a removed (or separated) configuration/position. Various exemplary embodiments of the invention relate to a suitably designed headset connector wherein the connector plug contact member 32 can be removed from the connector plug housing member 30, rotated, and then inserted in the connector plug housing member 30 for adjusting the pin orders. However, one skilled in the art will appreciate that various exemplary embodiments of the invention are not necessarily so limited and that in some embodiments the connector plug contact member 32 can be rotated relative to the connector plug housing member 30 without removing the connector plug contact member 32 from the connector plug housing member 30. For example, this type of configuration may be provided by a movable type connection, such as a rotatable connection for example, that allows for a flexible connection that can be repositioned without removal and reinsertion of the contact member.

The connector plug housing member 30 comprises an opening 44 suitably sized and shaped to removably receive an internal mating portion 46 of the connector plug contact member 32. According to various exemplary embodiments of the invention, the connector plug housing member 30 comprises contact pins 48, 50, 52, 54 suitably arranged to make electrical contact with the internal mating portion 46 of the connector plug contact member 32. Cable wires 56, 58, 60, 62 from the cable 22 are directly connected (or directly attached) to the contact pins 48, 50, 52, 54. For example, according to some embodiments, the direct connection may be provided by soldering (such as wherein the wires are soldered to contact pins inside plug housing member 30), however, any other suitable method of connecting the wires to the pins may be provided. As shown in the figures, contact pin 48 provides the ground signal, contact pin 50 provides the control/microphone signal, contact pin 52 provides the right audio channel signal, and contact pin 54 provides the left audio channel signal. As shown in FIGS. 2 and 3, the contact member 32 comprises internal contact parts 64, 66, 68, 70 extending from the contact areas to the internal mating portion 46.

As best illustrated in FIG. 3, the internal contact part 64 extends from the tip section 34 to the internal mating portion 46. The internal contact part 66 extends from the first ring section 36 to the internal mating portion 46. The internal contact part 68 extends from the second ring section 38 to the internal mating portion 46. The internal contact part 70 extends from the sleeve section 40 to the internal mating portion 46. According to some embodiments of the invention, the internal contact part 64 comprises a first diameter, the internal contact part 66 comprises a second diameter, the internal contact part 68 comprises a third diameter, and the internal contact part 70 comprises a fourth diameter. According to some embodiments of the invention, the second diameter is greater than the first diameter, the third diameter is greater than the second diameter, the fourth diameter is greater than the second diameter, and the fourth diameter is substantially equal to third diameter. Additionally, as shown in FIG. 3, the internal contact portion 68 only extends along an upper side of the internal mating portion, and the internal contact portion 70 only extends along a lower side of the internal mating portion. Furthermore, the offset lengths, different size diameters, and extension along the upper/lower side of the internal contact parts 64-70 allow for the connection to be made between the internal contact parts 64-70 of the contact member 32 and the contact pins 48-54 of the housing member 30.

For example, in some embodiments of the invention, a receiving area 72 of the opening 44 is suitably sized and shaped to receive the internal contact part 64. A receiving area 74 of the opening 44 is suitably sized and shaped to receive the internal contact part 66. A receiving area 76 of the opening 44 is suitably sized and shaped to receive the internal contact parts 68, 70. The receiving areas are provided within the housing member such that ends of the contact pins 48-50 are at their corresponding receiving areas.

When the contact member 32 is inserted in the housing member 30 as shown in FIG. 2, the connector plug provides an OMTP pinout configuration as the mic contact pin 50 is connected to the second ring section 38 (through internal contact part 68) and the ground contact pin 48 is connected to the sleeve section 40 (through the internal contact part 70).

With the contact member removed from the housing member 30 as shown in FIG. 3, the contact member can be rotated 180 degrees (along a central axis of the plug) in order to change the pin configuration.

Figure 4:
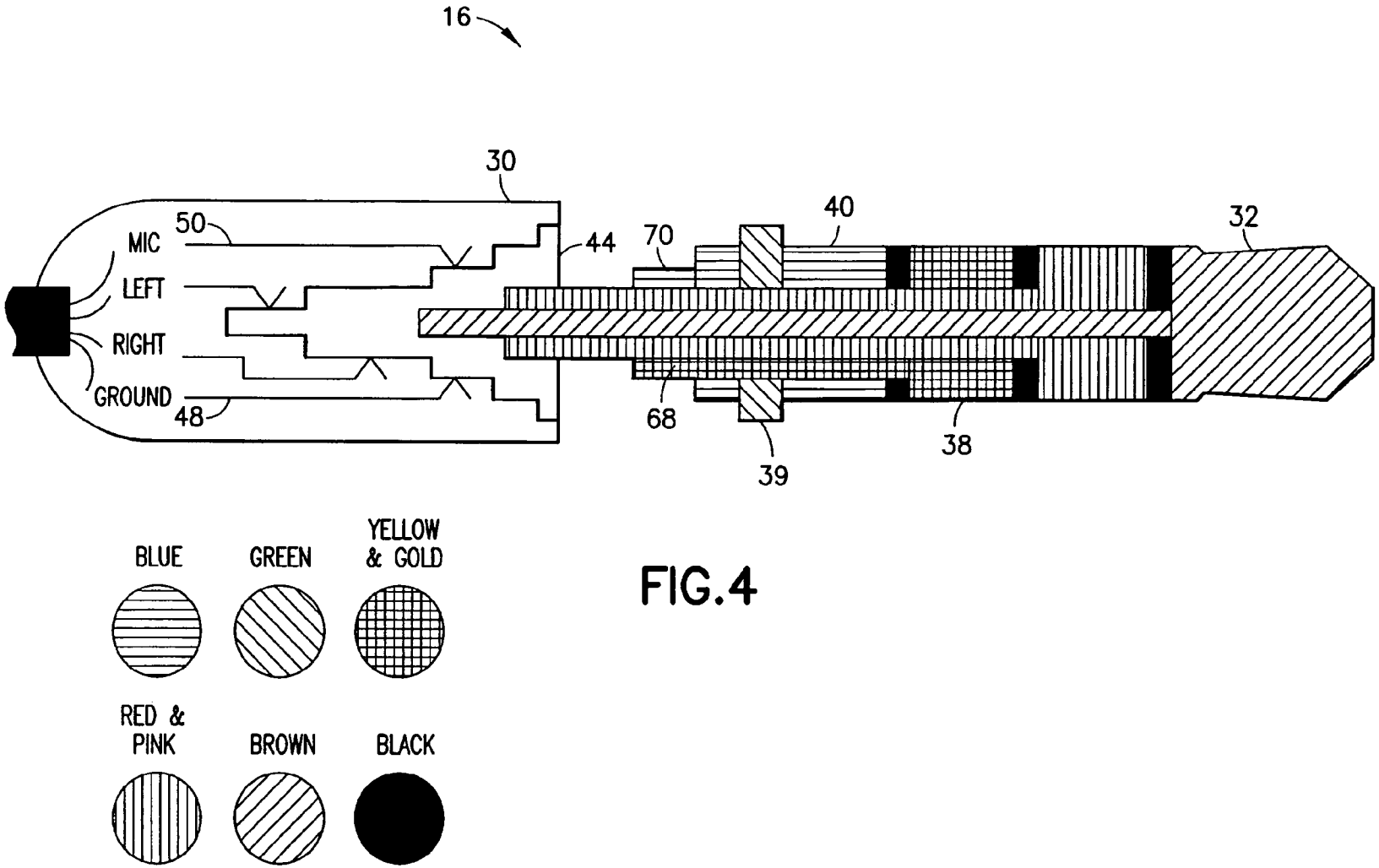
FIG. 4 is a cross section view of the connector plug section shown in FIG. 2 in a removed/separated and rotated configuration/position.

For example FIG. 4 shows the contact member 32 rotated 180 degrees from the first position/orientation of FIG. 3 (and from the first mated/received position of FIG. 2). Now, inserting the contact member 32 into the opening 44 of the housing member 30 in the orientation of FIG. 4, provides for a changed pin pattern. This changed pin pattern is further shown in FIG. 5, which shows the contact member 32 in the second inserted/mated position, wherein the connector plug provides an AHJ pinout configuration as the mic contact pin 50 is connected to the sleeve section 40 (through internal contact part 70) and the ground contact pin 48 is connected to the second ring section 38 (through the internal contact part 68).

Figure 5:
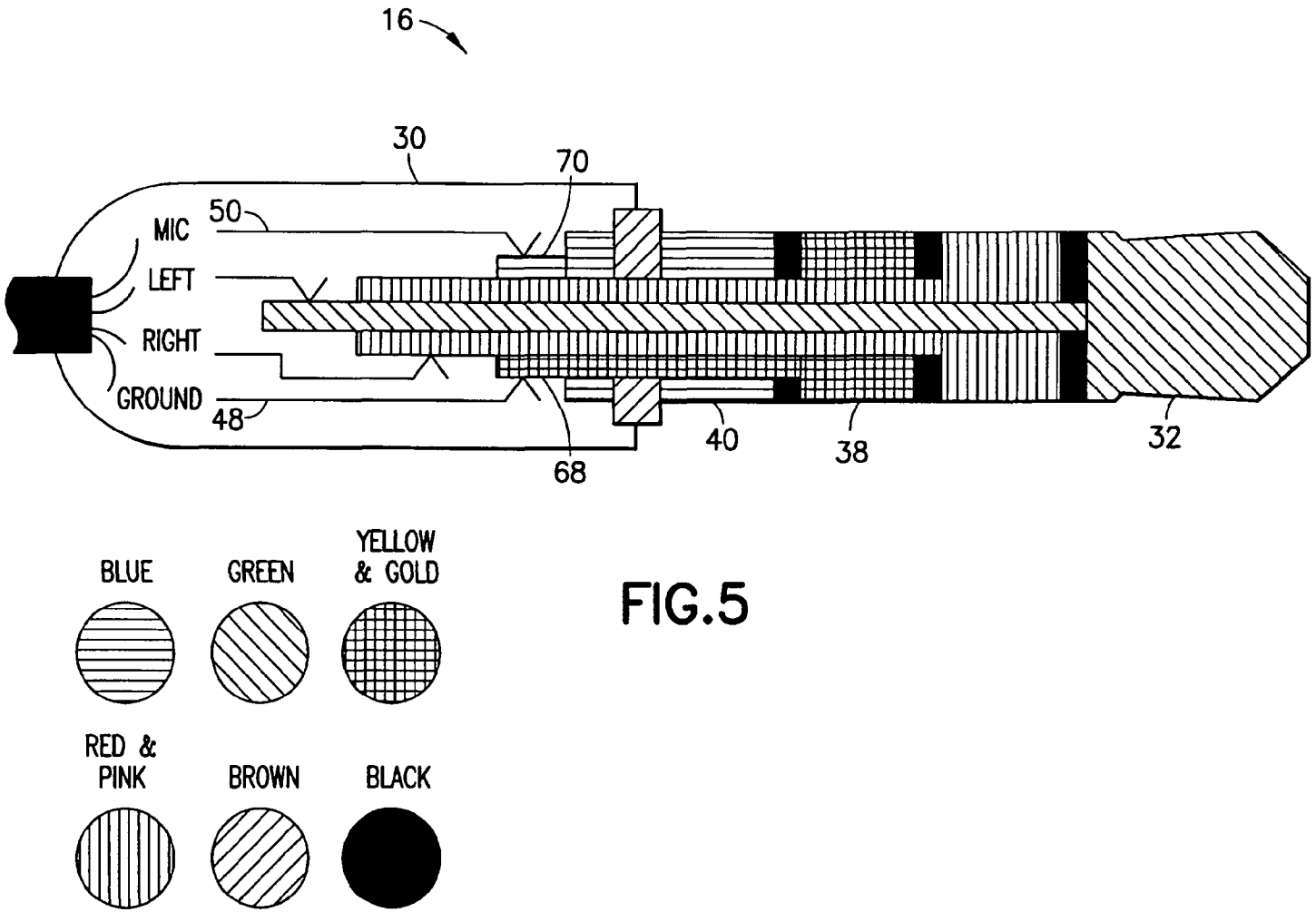
FIG. 5 is a cross section view of the connector plug section shown in FIG. 2 in a rotated and inserted/mated configuration/position.

According to various exemplary embodiments of the invention, the plug housing member 30 is generally used as a socket for the internal mating portion 46 of the contact member 32. Then pinning can be swapped by putting the plug inner part on OMTP or AHJ position. For example, the first inserted/mated position (as shown in FIG. 2) corresponds to the OMTP position. The second inserted/mated position (as shown in FIG. 5) corresponds to the AHJ position. This selection can be made in the accessory factory or when packing together with phone model, or even user can perform the change in contact member orientation, such as, for example if accessory is purchased separately. This selection phase will affect to locking mechanics, which can be one time locking or medium force locking (such as an interference fit, for example) or loose locking (such as a slight press fit for example) for user change pinning afterwards.

Figure 7:
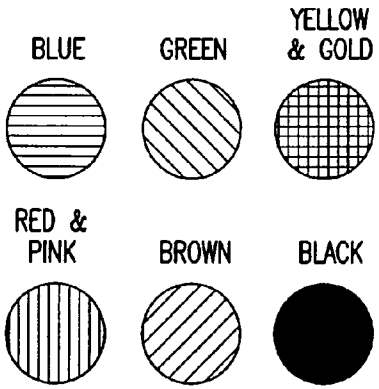
FIG. 7 is an end view of the connector plug section shown in FIG. 5.
Figure 7:
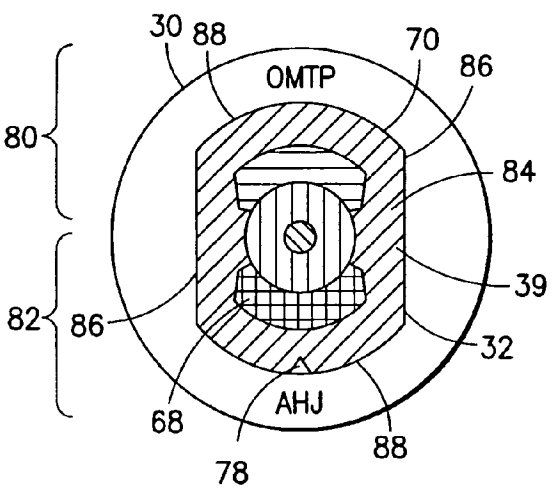
Figure 6:
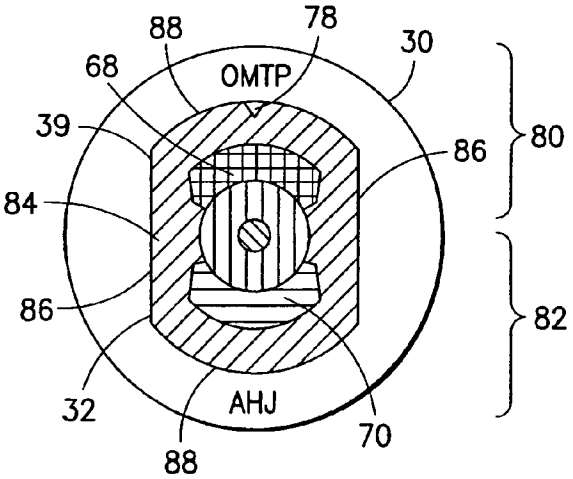
FIG. 6 is an end view of the connector plug section shown in FIG. 2.

According to some embodiments of the invention, markings may be provided on the housing member 30 and the contact member 32 to indicate the desired orientation. For example, FIG. 6 shows a marking 78 on the contact member 32 which is aligned with the OMTP letters on the housing member 30. This indicates an OMTP orientation of the contact member wherein the internal contact part 68 is aligned with an upper side 80 of the housing member 30, and the internal contact part 70 is aligned with a lower side 82 of the housing member 30. Similarly, FIG. 7 shows a marking 78 on the contact member 32 which is aligned with the AHJ letters on the housing member 30. This indicates an AHJ orientation of the contact member wherein the internal contact part 68 is aligned with the lower side 82 of the housing member 30, and the internal contact part 70 is aligned with upper side 80 of the housing member 30.

Figure 8:
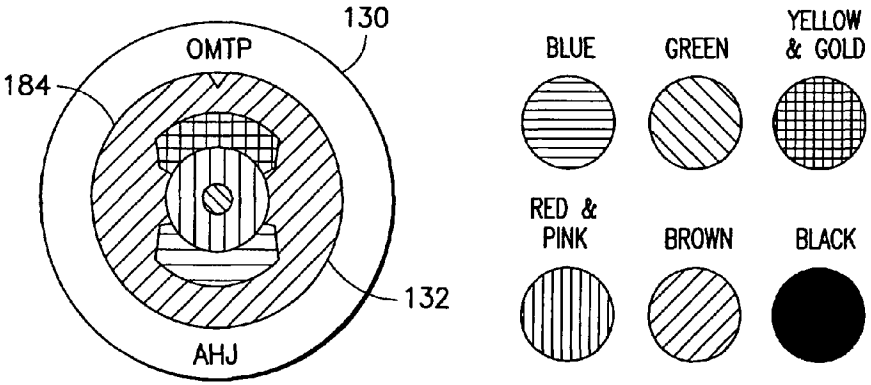
FIG. 8 is an end view of another example connector plug section incorporating features of the invention.

Still referring to FIGS. 6, 7, there is shown a general rectangular cross sectional shape of the stopper portion 84 of the contact member 32. According some embodiments of the invention, the general rectangular cross sectional shape may comprise substantially straight/flat lateral sides 86, and rounded top and bottom sides 88. This generally provides for a shape that can only be inserted into the housing in two orientations (wherein the orientations correspond with the OMTP and AHJ positions for the contact member 32), as the housing opening comprises a mating general rectangular shape to receive the stopper portion in the first position or the second position. However, those skilled in the art will appreciate that embodiments of the invention are not necessarily so limited, and that other shapes may be provided. Referring also to FIG. 8, another embodiment of the invention similar to the embodiment shown in FIGS. 2-7 is shown. In this embodiment the stopper section 184 of the contact member 132 has a cross sectional shape that is substantially circular. The substantially circular shape may be received in the opening of the housing member 130. In some embodiments, the stopper section 184 and/or the housing member 130 may comprise a slot or grove configuration to provide receiving of the contact portion in only the first position or the second position. This illustrates that other suitable shapes for the stopper section of the contact member could be provided.

Figure 9:
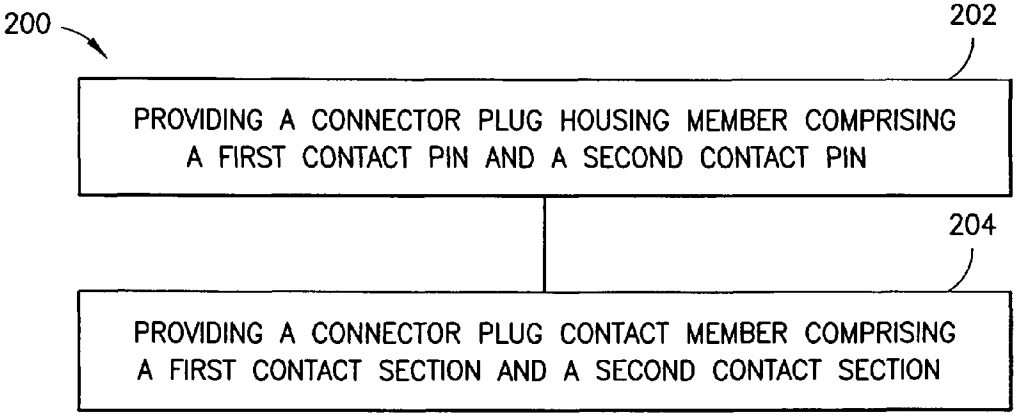
FIG. 9 is a block diagram of an exemplary method of the device shown in FIG. 1.

FIG. 9 illustrates a method 200. The method 200 includes providing a connector plug housing member comprising a first contact pin and a second contact pin (at block 202). Providing a connector plug contact member comprising a first contact section and a second contact section, wherein the connector plug contact member is configured to be removably received in the connector plug housing member in a first position, wherein the connector plug contact member is configured to be removably received in the connector plug housing member in a second position, wherein the first position corresponds to a first pinning order, and wherein the second position corresponds to a second pinning order. (at block 204). It should be noted that the illustration of a particular order of the blocks does not necessarily imply that there is a required or preferred order for the blocks and the order and arrangement of the blocks may be varied. Furthermore it may be possible for some blocks to be omitted.

Without in any way limiting the scope, interpretation, or application of the claims appearing below, a technical effect of one or more of the example embodiments disclosed herein is providing a selectable pinning order by properly orienting/positioning the internal contact parts in the housing member for OMTP pin configuration (see FIGS. 2, 6) or for AHJ position (see FIGS. 5, 7). According to some embodiments of the invention, the plug metal contact parts/areas are quite close to that of standard headset plugs, wherein only minor modification may be needed for the added provision of swapping contacts and a locking system. The housing member part can be made as standard piece by plug manufacturer and then use it with various outer shells for different accessory products. This swapping arrangement may be provided with various inner pin structures.

Technical effects of any one or more of the exemplary embodiments provide a changeable headset pin order enabling an easier alternative way of changing pin orders mobile electronic device usage when compared to conventional configurations. Although some exemplary embodiments of the invention may provide a small cost increase, the changeable configuration is generally still less expensive than a mechanical or electrical switch inside the plug. For example, with at least two industry accepted pinning orders (OMTP and AHJ), this causes two different versions for every accessory made for phones, one for OMTP and other for AHJ, even the accessory can be otherwise identical.

In conventional configurations an AHJ accessory generally will not work at all if plugged to OMTP jack and vice versa. Also many phone manufacturers must produce both version phones for different countries, standards or customers and so all wired accessory models are doubled. One of the conventional methods to alleviate the problem is to make two separate models, which causes inconvenience for manufacturing, warehousing, shops, and finally end users. This is common working model today. Another one of the conventional methods to alleviate the problem is to provide a manual switch inside the plug, but then plug will be very bulky and cannot fit to all phone models. Usability and reliability are main concerns in mechanical swapping switch. Also switch can be electronic switch and use microphone bias signal for correct mode, but that needs special detection mechanism, which is difficult to make compatible with all situations and all phone models.

A technical effect of one or more of the example embodiments disclosed herein is that the same accessory can be made for different needs, with no double stocks, and further enables new small designs and no "wrong" headsets for users.

While various exemplary embodiments have been described in connection substantially the same size plugs, in some embodiments of the invention other round shape plugs could also be provided, and with separate inner parts that can change a plug diameter from 3.5 mm to a plug diameter of 2.5 mm, or change a 4-pin to a 3-pin. Additionally, in some embodiments of the invention, DC-plugs may be provided. Also, plug pin swapping in accordance with the various exemplary embodiments of the invention is not only for wired headsets it can be used for video cables (video use same microphone pin on jack) and other accessories. Furthermore, it should be noted that embodiments of the invention may be provided for any suitable plug size other than 2.5 mm or 3.5 mm, such as a 6.3 mm plug size, for example.

Additionally, it should be noted that although a 'wired' headset device has been described, various exemplary embodiments may provide for using the plug as part of a wireless headset, such as a Bluetooth headset for example, wherein the headset plug connects to a jack of a wireless base section configured to communicate with an electronic device.

Furthermore, although various exemplary embodiments of the invention have been described in connection with the Open Mobile Telephony Platform (OMTP) pinning order and the American Headset Jack (AHJ) pinning order, alternate embodiments of the invention may be provided with any other changeable contact pin arrangements (other then OMTP and AHJ). Additionally, some embodiments of the invention may provide for changeable switching of any other suitable type of pin combination, such as stereo swapping, for example.

It should be understood that components of the invention can be operationally coupled or connected and that any number or combination of intervening elements can exist (including no intervening elements). The connections can be direct or indirect and additionally there can merely be a functional relationship between components.

As used in this application, the term 'circuitry' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory (ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (for example, any combination that is suitable, practicable and/or feasible) and are not limited only to those combinations described herein and/or included in the appended claims.

In one exemplary embodiment, an apparatus comprising a connector plug housing member and a connector plug contact member. The connector plug housing member comprising a first contact pin and a second contact pin. The connector plug contact member comprising a first contact section and a second contact section. The connector plug contact member is configured to be positioned in the connector plug housing member in a first position. The connector plug contact member is configured to be positioned in the connector plug housing member in a second position. The first position corresponds to a first pinning order. The second position corresponds to a second pinning order.

An apparatus as above wherein the first contact section is configured to be connected with the first contact pin in the first position. The second contact section is configured to be connected with the second contact pin in the first position. The first contact section is configured to be connected with the second contact pin in the second position. The second contact section is configured to be connected with the first contact pin in the second position.

An apparatus as above wherein the connector plug contact member is configured to be removably insertable into the connector plug housing member in the first position. The connector plug contact member is configured to be removably insertable into the connector plug housing member in the second position.

An apparatus as above wherein the connector plug housing member and the connector plug contact member are separate members.

An apparatus as above wherein the first pinning order comprises an Open Mobile Telephony Platform pinning order, and wherein the second pinning order comprises an American Headset Jack pinning order.

An apparatus as above wherein the connector plug contact member comprises a tip section, a first ring section, a second ring section, and a sleeve section.

An apparatus as above wherein the connector plug contact member comprises an internal mating portion having a first internal contact part offset from a second internal contact part.

An apparatus as above wherein the connector plug housing member is configured to receive the connector plug contact member in a locked configuration.

An apparatus as above wherein the connector plug housing member is configured to receive the connector plug contact member in a press fit configuration.

An apparatus as above wherein the first contact pin and the second contact pin correspond to audio signals channels.

An apparatus as above wherein the apparatus further comprises markings configured to indicate a pinning order corresponding to an orientation of the connector plug contact member relative to the connector plug housing member.

An apparatus as above wherein the apparatus is a headset connector plug.

A device comprising an earpiece section, an input control section, and an apparatus as above connected to the input control section.

In another exemplary embodiment, a method comprising providing a connector plug housing member comprising a first contact pin and a second contact pin. Providing a connector plug contact member comprising a first contact section and a second contact section. The connector plug contact member is configured to be removably received in the connector plug housing member in a first position. The connector plug contact member is configured to be removably received in the connector plug housing member in a second position. The first position corresponds to a first pinning order. The second position corresponds to a second pinning order.

A method as above wherein the first pinning order comprises an Open Mobile Telephony Platform pinning order.

A method as above wherein the second pinning order comprises an American Headset Jack pinning order.

In another exemplary embodiment, an apparatus comprising an earpiece section, an input control section, and a connector plug section. The input control section is connected to the earpiece section. The connector plug section is connected to the input control section. The connector plug section comprises a removable connector plug contact member. The removable connector plug contact member is configured to be removably received at the plug section in a first orientation and a second different orientation.

An apparatus as above wherein the connector plug section further comprises a connector plug housing member configured to receive the connector plug contact member.

An apparatus as above wherein the first and second orientations correspond to Open Mobile Telephony Platform and American Headset Jack pinning orders.

An apparatus as above wherein the connector plug section comprises a marking. The marking indicates a pinning order of the connector plug section based on the orientation of the connector plug contact member.

An apparatus as above wherein the apparatus is a headset device.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An apparatus, comprising:

a connector plug housing member comprising a first contact and a second contact; and a connector plug contact member comprising a first contact section and a second contact section;

wherein the first and second contacts are respectively coupled to a first and a second receiving area so as to receive the first contact section and the second contact section;

wherein the connector plug housing member and the connector plug contact member are arranged to make contact when the first and second contact sections are received by the first and second receiving areas, wherein the connector plug contact member is configured to be positioned in the connector plug housing member in a first position, wherein the connector plug contact member is configured to be positioned in the connector plug housing member in a second position, wherein the first position corresponds to a first pinning order, and wherein the second position corresponds to a second pinning order.

2. An apparatus as in claim 1 wherein the first contact section is configured to be connected with the first contact in the first position, wherein the second contact section is configured to be connected with the second contact in the first position, wherein the first contact section is configured to be connected with the second contact in the second position, and wherein the second contact section is configured to be connected with the first contact in the second position.

3. An apparatus as in claim 1 wherein the connector plug contact member is configured to be removably insertable into the connector plug housing member in the first position, and wherein the connector plug contact member is configured to be removably insertable into the connector plug housing member in the second position.

4. An apparatus as in claim 1 wherein the connector plug housing member and the connector plug contact member are separate members.

5. An apparatus as in claim 1 wherein the first pinning order comprises an Open Mobile Telephony Platform pinning order, and wherein the second pinning order comprises an American Headset Jack pinning order.

6. An apparatus as in claim 1 wherein the connector plug contact member comprises a tip section, a first ring section, a second ring section, and a sleeve section.

7. An apparatus as in claim 1 wherein the connector plug contact member comprises an internal mating portion having a first internal contact part offset from a second internal contact part.

8. An apparatus as in claim 1 wherein the connector plug housing member is configured to receive the connector plug contact member in a locked configuration.

9. An apparatus as in claim 1 wherein the connector plug housing member is configured to receive the connector plug contact member in a press fit configuration.

10. An apparatus as in claim 1 wherein the first contact and the second contact correspond to audio signals channels.

11. An apparatus as in claim 1 wherein the apparatus further comprises markings configured to indicate a pinning order corresponding to an orientation of the connector plug contact member relative to the connector plug housing member.

12. An apparatus as in claim 1 wherein the apparatus is a headset connector plug.

13. A device comprising:

an earpiece section;

an input control section; and an apparatus as in claim 1 connected to the input control section.

14. A method, comprising:

providing a connector plug housing member comprising a first contact and a second contact; and providing a connector plug contact member comprising a first contact section and a second contact section;

wherein the first and second contacts are respectively coupled to a first and a second receiving area so as to receive the first contact section and the second contact section;

wherein the connector plug housing member and the connector plug contact member are arranged to make contact when the first and second contact sections are received by the first and second receiving areas, wherein the connector plug contact member is configured to be removably received in the connector plug housing member in a first position, wherein the connector plug contact member is configured to be removably received in the connector plug housing member in a second position, wherein the first position corresponds to a first pinning order, and wherein the second position corresponds to a second pinning order.

15. A method as in claim 14 wherein the first pinning order comprises an Open Mobile Telephony Platform pinning order.

16. A method as in claim 14 wherein the second pinning order comprises an American Headset Jack pinning order.

17. An apparatus, comprising:

an earpiece section;

an input control section connected to the earpiece section; and a connector plug section connected to the input control section, wherein the connector plug section comprises a removable connector plug contact member and a connector plug housing member, wherein the removable connector plug contact member is configured to be removably received at the connector plug housing member in a first orientation and a second different orientation;

wherein first and second contacts of the connector plug housing member are respectively coupled to a first and a second receiving area so as to receive a first contact section and a second contact section of the removable connector plug contact member, wherein the connector plug housing member and the removable connector plug contact member are arranged to make contact when the first and second contact sections are received by the first and second receiving areas.

18. An apparatus as in claim 17 wherein the first and second orientations correspond to Open mobile Telephony Platform and American Headset Jack pinning orders.

19. An apparatus as in claim 17 wherein the connector plug section comprises a marking, wherein the marking indicates a pinning order of the connector plug section based on the orientation of the connector plug contact member.

20. An apparatus as in claim 17 wherein the apparatus is a headset device.

21. The apparatus of claim 1 wherein the connector plug contact member is configured to be removable from the connector plug housing member, wherein the connector plug contact member is configured to be rotatable after removal from the connector plug housing member, and wherein the connector plug contact member is configured to be insertable into the connector plug housing member for adjusting pin orders.

* * * * *